US008555965B2

(12) United States Patent
Roy et al.

(10) Patent No.: US 8,555,965 B2
(45) Date of Patent: Oct. 15, 2013

(54) HIGH FREQUENCY SURFACE TREATMENT METHODS AND APPARATUS TO EXTEND DOWNHOLE TOOL SURVIVABILITY

(75) Inventors: Indranil Roy, Sugar Land, TX (US); Manuel Marya, Sugar Land, TX (US); Rashmi Bhavsar, Houston, TX (US); Chris Wilkinson, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 394 days.

(21) Appl. No.: 12/774,809

(22) Filed: May 6, 2010

(65) Prior Publication Data

US 2011/0272134 A1 Nov. 10, 2011

(51) Int. Cl.

| | |
|---|---|
| ***E21B 28/00*** | (2006.01) |
| ***C23C 8/60*** | (2006.01) |
| ***B05D 1/12*** | (2006.01) |

(52) U.S. Cl.

USPC ..... 166/242.4; 166/177.1

(58) Field of Classification Search

USPC ..... 166/247, 177.1, 242.4; 148/97, 224, 148/525, 565, 903; 427/180, 565

See application file for complete search history.

(56) References Cited

U.S. PATENT DOCUMENTS

| | | | | |
|---|---|---|---|---|
| 2,460,919 | A * | 2/1949 | Bodine, Jr. | 451/36 |
| 3,615,881 | A * | 10/1971 | Greene | 148/97 |
| 3,650,846 | A * | 3/1972 | Holland et al. | 148/565 |
| 4,365,136 | A * | 12/1982 | Gottlieb | 219/121.65 |
| 4,490,411 | A * | 12/1984 | Feder | 427/543 |
| 4,887,493 | A * | 12/1989 | Drake | 76/5.1 |
| 5,833,918 | A * | 11/1998 | Matossian et al. | 266/251 |
| 5,961,732 | A * | 10/1999 | Patrin et al. | 134/7 |
| 6,045,864 | A * | 4/2000 | Lyons et al. | 427/255.23 |
| 6,425,745 | B1 * | 7/2002 | Lavin | 418/48 |
| 6,936,145 | B2 * | 8/2005 | Sunthankar et al. | 204/298.41 |
| 2003/0232132 | A1 * | 12/2003 | Muehlberger | 427/180 |
| 2005/0233091 | A1 * | 10/2005 | Kumar et al. | 427/569 |
| 2008/0268164 | A1 * | 10/2008 | Thayer et al. | 427/446 |
| 2011/0014489 | A1 * | 1/2011 | Ivanov et al. | 428/603 |

FOREIGN PATENT DOCUMENTS

| | | |
|---|---|---|
| FR | 2812284 | 7/2000 |
| FR | 2812286 | 7/2000 |
| WO | 9320247 | 10/1993 |

OTHER PUBLICATIONS

T. Roland, D. Retraint, K. Lu, J. Lu, Effect of Surface Nano Crystallization on tribological properties of Stainless Steel, Materials Science Forum, 524-525 (2006) 717-722.

B. Wang, J. Lu, K. Lu, Chromizing behaviors of a low carbon steel processed by means of surface mechanical attrition treatment, Acta Materialia, 53 (7) (2005) 2081-2089.

K. Lu, J. Lu, Nanostructured surface layer on metallic materials induced by surface mechanical attrition treatment, Materials Science and Engineering A, 375-377 (2004) 38-45.

* cited by examiner

*Primary Examiner* — Kenneth L Thompson
(74) *Attorney, Agent, or Firm* — Jeffrey R. Peterson

(57) ABSTRACT

A downhole device with compressive layer at the surface thereof. Such devices may be particularly well suited for survivability in the face of potentially long term exposure to a downhole environment. Techniques for forming protective compressive layers at the surfaces of such devices may include positioning devices within a chamber for bombardment by high frequency particles. As a manner of enhancing the compressive layer thickness and effectiveness, low temperature conditions may be applied to the device during the high frequency treatment.

19 Claims, 5 Drawing Sheets

HIGH FREQUENCY SURFACE TREATMENT METHODS AND APPARATUS TO EXTEND DOWNHOLE TOOL SURVIVABILITY

FIELD

Embodiments described relate to downhole devices treated for exposure to well environments. In particular, techniques for treating alloy and metal surfaces of device components are detailed. Such treatments may be directed at enhancing the thickness of a compressive layer and crack resistance at the indicated surfaces. This may be achieved through introduction of a deep compressive nanostructured layer character to the surfaces.

BACKGROUND

Exploring, drilling and completing hydrocarbon and other wells are generally complicated, time consuming and ultimately very expensive endeavors. In recognition of the potentially enormous expense of well completion, added emphasis has been placed on well monitoring and maintenance throughout the life of the well. By the same token, added emphasis may be placed on materials used in the construction of downhole tools, equipment, tubulars and other devices in light of the harsh downhole environment. All in all, such added emphasis may increase the life of such equipment, if not the life and productivity of the well itself. As a result, this may help ensure that the well provides a healthy return on the significant investment involved in its completion.

The introduction of downhole devices such as the above noted tools, equipment, and tubulars is standard practice throughout well completion and production operations. In many cases, such as with production tubing, the devices are left disposed within the well for extended periods of time, such as for the useful life of the well. Depending on the hydrocarbon reservoir itself and the parameters of the operation, such durations may exceed several years.

Unfortunately, devices such as production tubing may include components susceptible to damage upon exposure to the downhole conditions of the well. Namely, stainless steel or other metals and alloys which constitute the main body of such devices are particularly prone to corrosion and environmental cracking upon prolonged exposure to downhole well conditions. For example, water cut, chemical makeup, and pressure or temperature extremes of the downhole environment may tend to induce corrosion and cracking in exposed metal and alloys. Indeed, corrosives such as hydrogen sulfide, halides, chloride, and carbon dioxide, common in most hydrocarbon wells, generally play a substantial role in corrosion and cracking of downhole devices and limiting the useful life of such exposed devices.

In order to address the noted cracking issue, alternative materials may be utilized to make up the main body structure of downhole devices. For example, any number of austenitic nickel-chromium-based superalloys may be utilized in constructing a downhole tubular such as the above noted production tubing. Such superalloys are particularly resistant to corrosion and cracking upon exposure to the harsh chemical environment common to hydrocarbon wells.

Unfortunately, it is cost prohibitive to employ such superalloys on all downhole devices. Indeed, constructing the noted production tubing of a nickel-chromium-based superalloy, would be so expensive that it would ultimately be far cheaper to complete the well, produce through stainless production tubing, and replace and repair the corroded tubing over time. Such prolonged maintenance may run several hundred thousand dollars and yet fail to completely keep the deteriorating tubing in a usable condition. Ultimately, the tubing may be replaced as noted or the well prematurely shut down at a significant cost in terms of lost production.

In light of the issues noted above, efforts have been made to improve corrosion crack resistance for less expensive materials such as stainless steel. For example, downhole device parts are often subjected to conventional shot peening. Similar to a small scale sand blasting technique, shot peening is a technique whereby ceramics or other heavy particles, significantly less than about 2 mm in size, are directed with substantial velocity at device parts. As such, a compressive layer is formed at the surfaces of such parts leaving them less susceptible to corrosion cracking.

Unfortunately, while shot peening is effective in extending the life of downhole device parts, the effect is limited. For example, the achievable thickness of the compressive layer is practically limited to less than about a micron due to the tendency of grain dislocations to effect material recovery in the face of shot peening. Furthermore, devices such as the above noted tubulars do not readily lend themselves to shot peening. For example, it may be beneficial to treat both inner and outer diameter surfaces of production tubing. However, treating the inner surface of such tubing is not available via shot peening. Thus, as a practical matter, shot peening treatments are generally limited to drill collars, testing tools, ball valves, and other discrete parts. Further, even where employed, the effectiveness of shot peening remains limited due to the noted limitations on compressive layer thicknesses.

SUMMARY

A method of treating material for exposure to downhole environments is disclosed. The material may be positioned within a chamber adjacent an high frequency generator with the generator employed to apply a frequency in the chamber. As such, a surface of the material may be impacted with particles in the chamber to attain the noted treatment. The material may then be incorporated into the downhole tool.

DETAILED DESCRIPTION

Embodiments are described with reference to certain types of downhole hydrocarbon recovery operations. In particular, focus is drawn to tools and techniques which may be employed in conjunction with completion assemblies or production tubing. However, tools and techniques detailed herein may be employed in a variety of other hydrocarbon operations. These may include deployment devices such as coiled tubing, wireline, or slickline as well as a host of downhole tools such as testing devices or perforating guns. Further, a variety of device components such as drill collars or plates and bars of various geometries may undergo high frequency treatment according to techniques detailed herein. Regardless, downhole devices may be provided with enhanced resistance to stress cracking, galling, wear and contact fatigue via high frequency techniques described below. Indeed, overall strength and load bearing capacity may also be improved through employment of such techniques.

Figure 1:
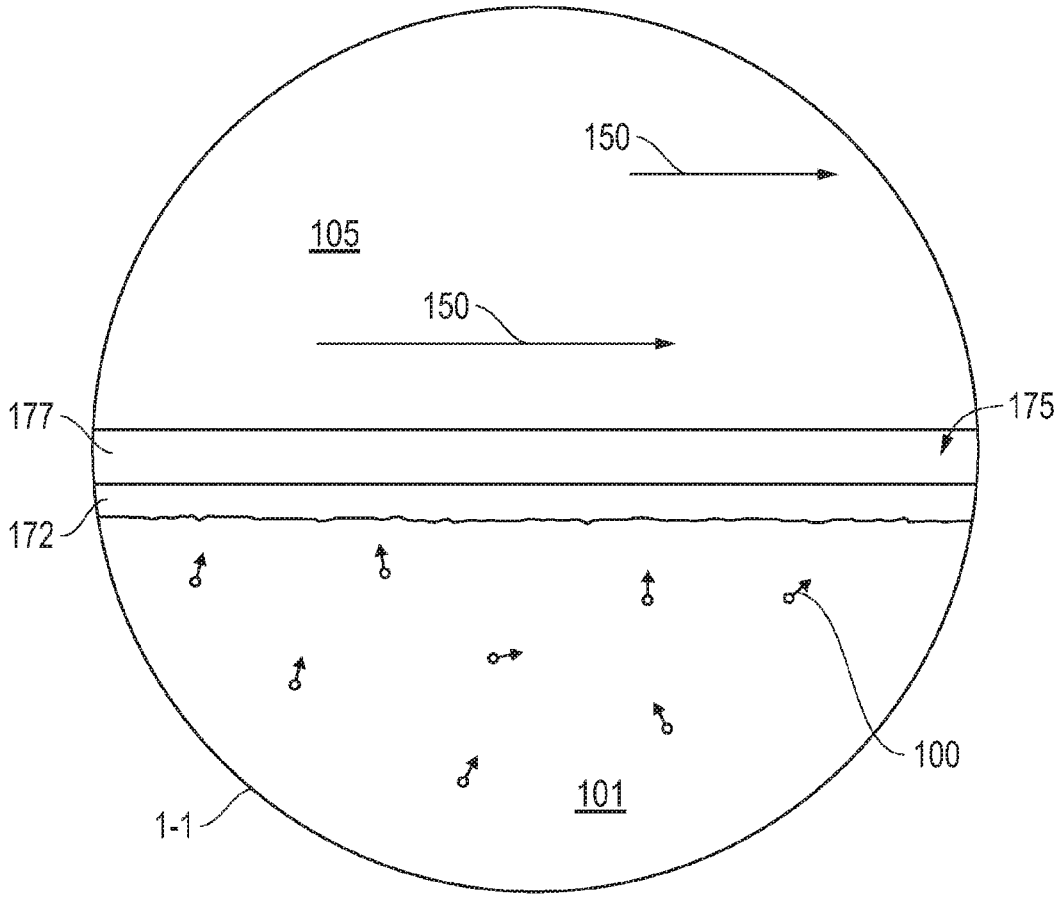
FIG. 1 is an enlarged view of high frequency surface treatment of a device taken from 1-1 of FIG. 2A.

Referring now to FIG. 1, an enlarged partial view of embodiment of a high frequency surface treated tubular 175 is depicted. As used herein, the term "high frequency" is meant to refer to a frequency range over about 50 Hz, generally ultrasonic (over about 20 kHz). Additionally, as indicated above, a variety of downhole devices may be treated according to techniques detailed herein. However, for sake of explanation, treatment of a tubular 175 in the form of production tubing is described. In the embodiment shown, the outer surface of the tubular 175 is exposed to high frequency particles 100 within the space 101 of an high frequency chamber 260 (see FIG. 2). Thus, as described below, a frequency may be applied to the space 101 and particles 100 that ultimately results in the formation of an outer compressive layer 172 at the noted outer surface. By way of contrast, the underlying layer 177 of the tubular 175 remains untreated in the embodiment shown. However, the surface of this layer 177 may also be treated as described below.

The bombardment of the outer surface of the tubular 175 with particles 100 may proceed according to conventional high frequency treatments. For example, traditional surface mechanical attrition treatment frequencies of between about 50 Hz and about 25 kHz may be applied via a conventional high frequency generator 200 (see FIG. 2). However, as a matter of enhancing the depth and effectiveness of the compressive layer 172 additional measures may be taken as noted below. Indeed, while the below embodiments describe high frequency treatments with the particles 100, the particles may additionally be introduced in a high velocity manner so as to initially ballistically impinge the tubular 175 akin to conventional shot peening techniques.

In the embodiment depicted, particles 100 ranging from about 0.5 to 10 mm in diameter may be employed for high frequency bombardment of the surface so as to form the compressive layer 172. As opposed to more common high frequency particle sizes on the nanometer scale, the larger particle size range employed in the embodiment of FIG. 1 may lead to a greater depth of the compressive layer 172. That is, the greater the mass of the particles, the greater the impact on the surface and ultimately the depth of the forming nanostructured compressive layer 172. Thus, by the same token, relatively spherical particles such as ceramic, steel and chromium are often employed as the high frequency particles 100. Furthermore, particles 100 may be employed which are configured for delivering material to the surface of the tubular 175 and alloying therewith as a manner to enhance the forming compressive layer 172.

In addition to employing comparatively larger particles 100, the material of the tubular 175 may be selected for effective susceptibility to such high frequency treatment. For example, a precipitation hardening metal and other low stacking fault energy materials may be utilized. These may include stainless steel, a nickel-based, or other suitable alloy may be utilized to encourage the growth in depth of the compressive layer 172. More specifically, such materials may employ precipitation to discourage grain boundary, dislocation motion which tends to minimize the impact of the high frequency treatment to a degree. In effect, such materials may discourage recovery by increasing the amount of activation energy required for the noted dislocations to migrate.

In addition to the use of precipitation hardening materials, other measures may be taken to discourage material recovery in the face of high frequency treatment. In fact, in the embodiment of FIG. 1, the influx of a temperature reducing fluid 150 is perhaps even more notable than the particle 100 and tubular material selection. The introduction of such a fluid helps keep the temperature of the treated portion of tubular 175 below room temperature, preferably below 0° C. As a result, the amount of activation energy available for material recovery is kept to a minimum, thereby allowing a greater depth to be achieved of the nanostructured compressive layer 172. In the embodiment shown, the fluid 150 is liquid nitrogen, carbon dioxide or argon that is directed through an interior 105 of the tubular 175 during the treatment application. Thus, the treatment temperature is kept at cryogenic levels, say substantially less than ⁻100° C.

All in all, the practical achievable depth of the compressive layer 172 may exceed 250 microns –2 mm or more. This may be about 2-5 times greater than the achievable depth without introduction of such a temperature reducing fluid 150. As detailed further below, this may translate into a substantial reduction in stress cracking, making such treated materials particularly well suited for exposure to the downhole environment of a hydrocarbon well.

Figure 2A:
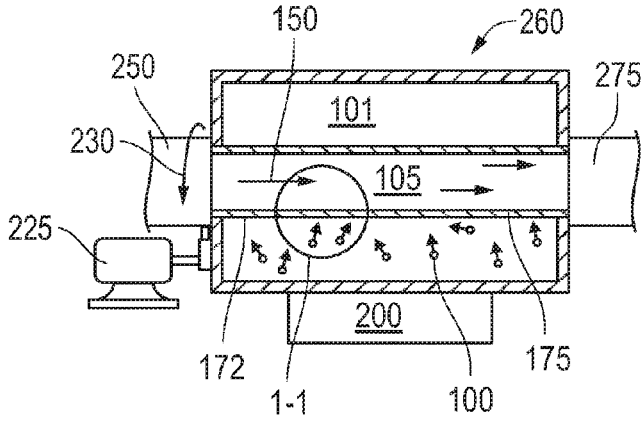
FIG. 2A is a side cross-sectional view of a tubular form of the device of FIG. 1 in an high frequency chamber for exterior surface treatment thereof.

Referring now to FIG. 2A, a side cross-sectional view of the entire high frequency chamber 260 referenced above is depicted. In this view, the section of tubular 175 accommodated is shown running the width of the chamber 260 and secured at either end by supportive tubing 250, 275 as described further below. Thus, the outer surface of the tubular 175 may be fully subjected to the high frequency particles 100 and their frequency of vibration as driven by the adjacent high frequency generator 200. As a result, the above described compressive layer 172 may be formed. In one embodiment, the surfaces of the tubular are initially coated with a dye that is naturally removed over the course of the high frequency treatment. Thus, effective treatment may be visibly confirmed following the procedure.

In the embodiment shown, a rotation mechanism is also provided. More specifically, rotatable supportive tubing 250 is provided to interface a rotation motor 225. With the tubular 175 firmly accommodated by the rotatable supportive tubing 250, the rotation motor 225 may be employed to effect rotation of the tubular 175 within the chamber 260. Note the rotation evidenced by the arrow 230. By the same token, stationary supportive tubing 275 may be provided at the opposite end of the chamber 260. This tubing 275 may be configured to sealably accommodate the tubular 175, while allowing for its free rotation therein. This rotation of the tubular 175 may promote a more even distribution of exposure to the particles 100 bombarding its outer surface during the high frequency application. Thus, a more uniform compressive layer 172 may ultimately be formed in terms of thickness. Furthermore, such rotation may reduce the overall amount of processing time.

As noted above, the thickness of the forming compressive layer 172 may be promoted by the running of the application in sub-zero conditions. In particular, keeping the tubular surface at a reduced temperature may dramatically improve achievable thickness of the compressive layer 172. Along these lines, the temperature reducing fluid 150 is depicted as pumped directly through the interior 105 of the tubular 175 via conventional means.

Figure 2B:
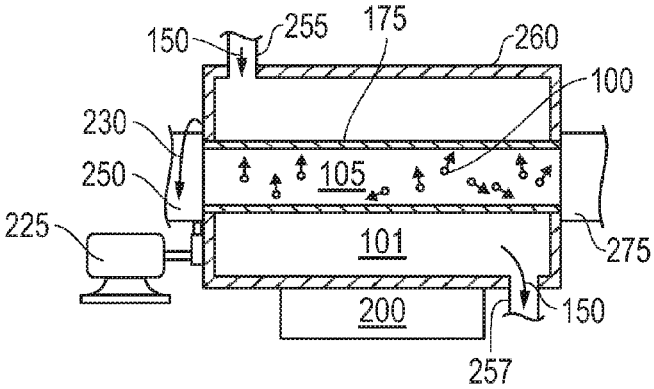
FIG. 2B is a side cross-sectional view of the chamber of FIG. 2A with high frequency particles located for interior surface treatment of the tubular device.

Continuing now with reference to FIG. 2B, treatment of the interior surface of the tubular 175 may proceed to form an inner compressive layer 279 in a manner similar to formation of the outer compressive layer 172. That is, while resistance to cracking and the downhole environment may be important for the exterior of the tubular 175, such durability may also be important for the inner surface of the tubular 175. For example, the interior of the tubular 175 may be exposed to treatment or recovery 350 fluids over the course of completions and production (see FIGS. 3 and 4). Such fluids may be similarly harsh, particularly where the tubular 175 is configured for long term or permanent placement such as the production tubing depicted in figures herein.

Treatment of the inner surface as depicted in FIG. 2B reveals high frequency particles 100 at the interior whereas the temperature reducing fluid 150 is introduced in the space 101 of the chamber 260 outside of the tubular 175. More specifically, inlet 255 and outlet 257 lines are provided to allow for circulation of the fluid 150 via conventional means. Further, it is worth noting that an advantage of the high frequency treatment, as opposed to say, blasting, is the fact that a direct line is not required between the high frequency generator 200 and the particles 100. Thus, the ability to treat the inner surface of the tubular 175 by way of a generator 200 that is distanced from the tubular 175 and blocked by its outer surface is of no significant concern. Rather, the generator 200 has sufficient effect on the particles 100 so as to form the inner compressive layer 279.

Figure 2C:
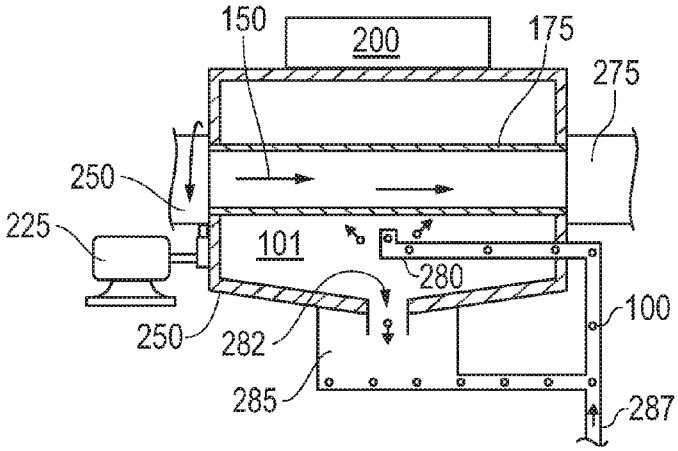
FIG. 2C is a side cross-sectional view of an alternate embodiment of the chamber for surface treatment of the device.

Referring now to FIG. 2C, an alternate embodiment of the high frequency chamber 260 and generator 200 assembly is depicted with the generator 200 positioned atop the chamber 260. In this embodiment, a recirculation and focused delivery of high frequency particles 100 may be achieved. As shown, an outlet port 282 is provided below the chamber 260 for drainage and recirculation of the particles 100. So, for example, particles 100 may bombard the tubular 175, drain to a collector 285 below the chamber 260 and circulate back through pumping 287 and targeting 280 lines into the chamber 260. Use of the targeting line 280 may allow for the focused delivery of the high frequency particles 100 to the tubular 175. So, for example, in the embodiment shown, the tubular 175 may be rotated and laterally advanced relative the line 280, thereby allowing for a more focused and controlled treatment of the outer surface. Indeed, in an alternate embodiment, the line 280 may be configured to terminate at the interior 105 of the tubular 175 for treatment of the inner surface.

During or following high frequency treatment with the particles 100, the targeting line 280 as depicted in FIG. 2C may also be well suited for delivery of ultra-fine metal powders. Thus, a protective overlay may be provided to further improve downhole survivability for the tubular 175. Such powders may be cryomilled or spray atomized powders of chromium, molybdenum, nickel or other suitable materials. Additionally, other forms of alloying or plating may take place in the chamber 260 following initial high frequency treatments. Furthermore, laser peening may be directed at hard to reach corners or features of the tubular 175 or other target device, perhaps of more complex architecture.

Figure 3A:
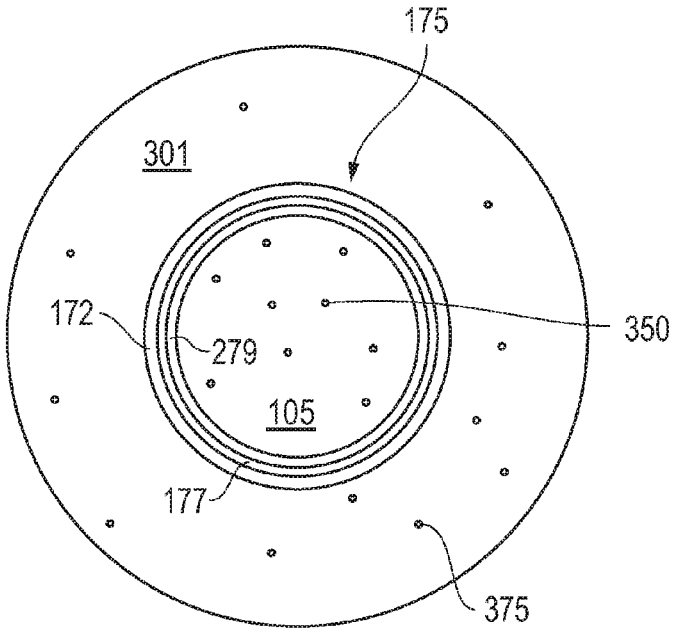
FIG. 3A is a cross-sectional view of a high frequency treated tubular positioned in a well to serve as production tubing.

Referring now to FIG. 3A, the tubular 175 is depicted cross-sectionally within a hydrocarbon well 301, serving as production tubing. The environment of the well 301 may be quite harsh, subjecting the tubular 175 to high temperatures, pressures and corrosives 375 as described above. However, due to high frequency treatment as described herein, the tubular 175 may be equipped with an outer compressive layer 172 and well suited for long term exposure to such an environment. Furthermore, as described above, an inner compressive layer 279 may be provided at the opposite side of the underlying layer 177 of the tubular 175. Thus, the inner surface of the tubular 175 may be protected from exposure to hydrocarbon recovery fluids 350, corrosives 375 as noted above, or treatment fluids directed downhole from surface prior to recovery.

Figure 3B:
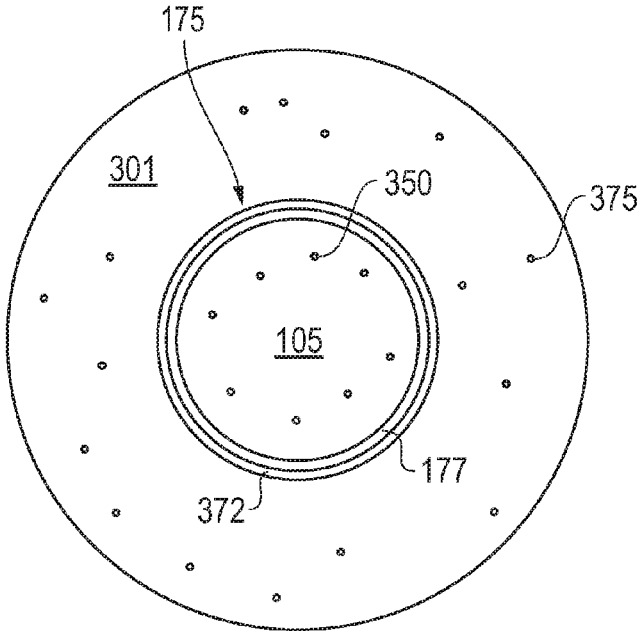
FIG. 3B (Prior Art)
FIG. 3B is a view of a prior art tubular positioned in a well to serve as production tubing.

By way of comparison, a tubular 175 treated according to techniques of the prior art such as blasting is depicted in FIG. 3B. In this view, the tubular is again positioned in the well 301 to serve as production tubing. However, long term exposure to downhole conditions, corrosives 375, recovery fluids 350 and the like may be of concern for such a tubular 175 serving as production tubing. For example, as detailed above, the depth or thickness of the outer compressive layer 372 is limited by the tendency of grain dislocations to recover at conventional processing temperatures.

In addition to the limited thickness of the outer compressive layer 372, no inner compressive layer is even present on the tubular 175 of FIG. 3B. Thus, the interior 105 of the tubular 175 remains nakedly exposed to the downhole environment, corrosives 375, and recovery fluids 350. Furthermore, even before recovery, the interior 105 of the tubular 175 may be subject to the self-induced rigors of various treatment fluids. All in all, such a prior art tubular 175 may not be particularly well suited for long term use as downhole production tubing, regardless of prior surface treatment. By contrast, consider a stainless steel based tubular 175, treated with particles 100 of between about 1 and 9 mm in sub-zero conditions according to techniques described above (see FIG. 1). Such a tubular 175, as depicted in FIG. 3A, may be expected to display between a 10% and 70% greater degree of resistance to corrosion cracking as compared to the prior art tubular 175 of FIG. 3B.

Figure 4:
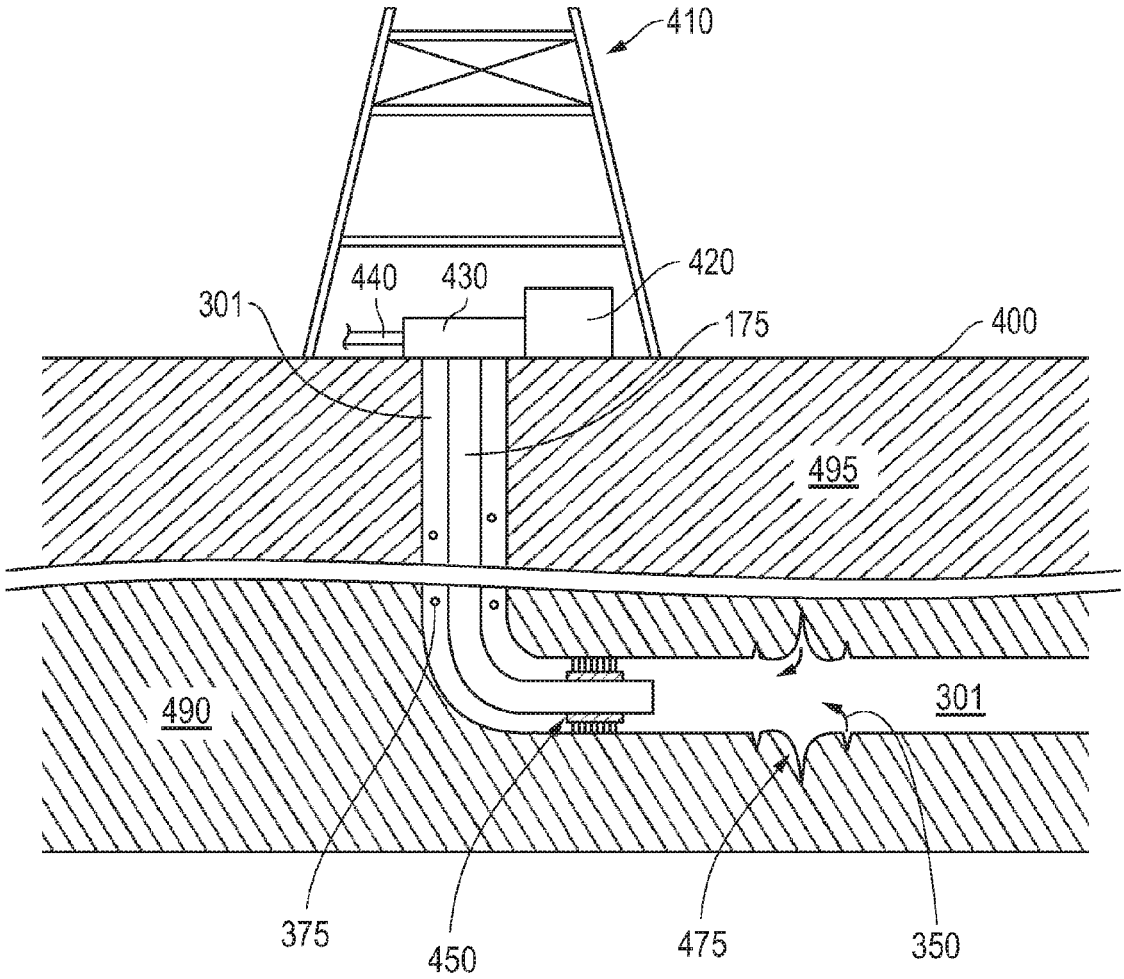
FIG. 4 is an overview of an oilfield accommodating a well with an high frequency treated downhole tubular disposed therein to serve as production tubing.

Referring now to FIG. 4, an overview of an oilfield 400 is shown accommodating the well 301 of FIG. 3A. In this view, the use of the tubular 175 as production tubing is readily apparent. Indeed, the tubular 175 extends downhole traversing various formation layers 495, 490 eventually terminating adjacent a production region 475. In the embodiment shown, a packer 450 is depicted securing the tubular 175 in place for recovery of hydrocarbon fluids 350 from the production region 475.

At the surface, a rig 410 is shown over a wellhead 430, providing a platform from which a variety of well applications may be run. However, during the production phase depicted, a production line 440, control unit 420 and a host of pumping equipment may serve the most pertinent functions for recovery. Regardless, production and recovery operations may proceed for an extended period of time without undue concern over corrosion cracking and premature failure of the tubular 175 employed.

Figure 5:
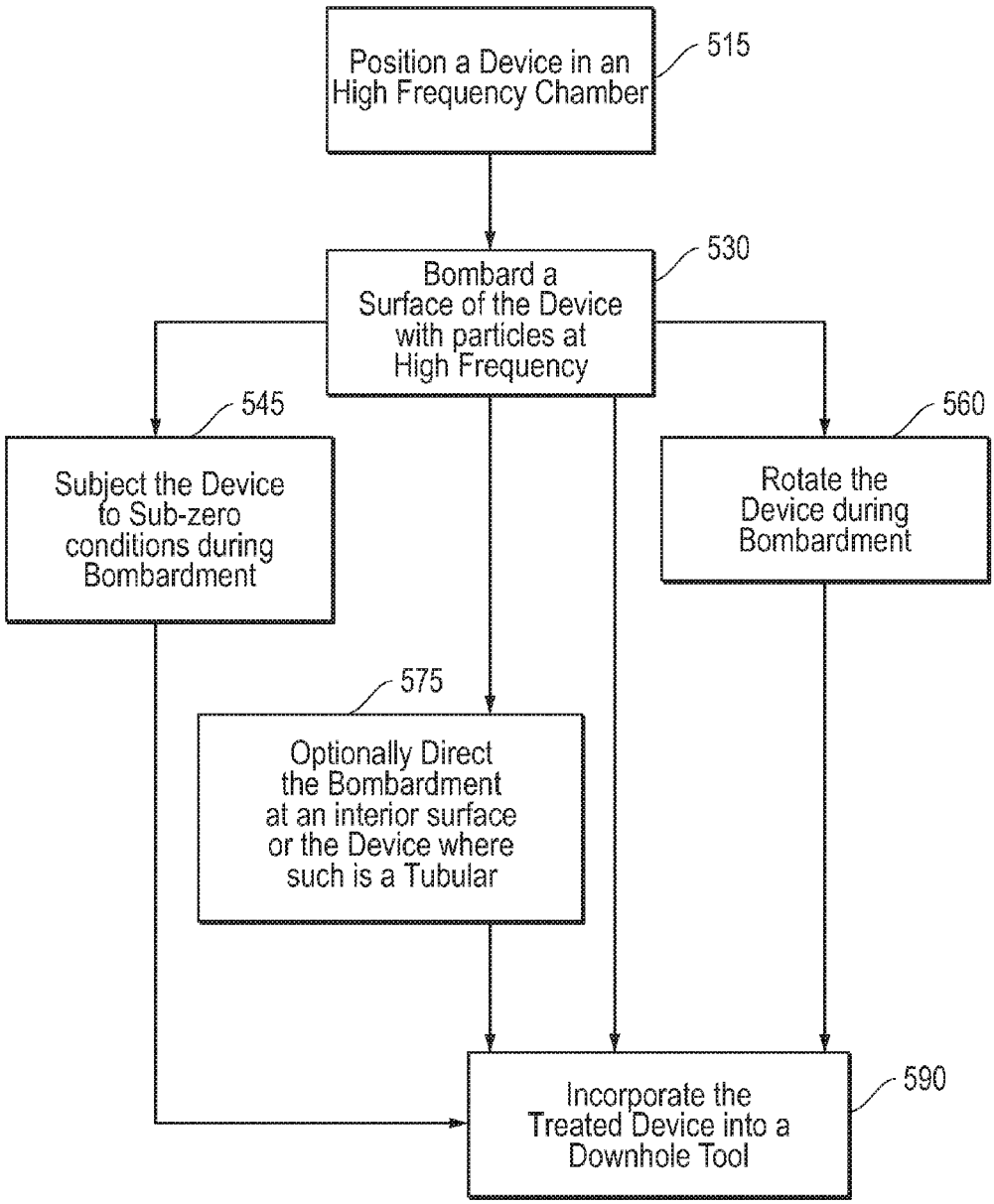
FIG. 5 is a flow-chart summarizing an embodiment of treating and utilizing a high frequency treated downhole device.

Referring now to FIG. 5, a flow-chart is shown summarizing an embodiment of treating and utilizing an downhole device treated at high frequency such as the aforementioned tubular. As indicated at 515 and 530, the device may be positioned in an high frequency chamber and bombarded with particles via an adjacent high frequency generator. Ultimately, the device may be incorporated into a downhole tool as indicated at 590 and, due to the high frequency treatment, be well suited for exposure to a well environment.

As a matter of further enhancing the effectiveness of the high frequency treatment, additional measures may be taken in processing the noted device. For example, the device may be subjected to sub-zero, or even cryogenic, temperatures during the treatment as indicated at 545. Thus, a thicker compressive layer may be formed. Further, the device may be rotated as indicated at 560 during processing so as to increase the uniformity of treatment as well as the rate. Additionally, as indicated at 575, in circumstances where the device is tubular in nature, an interior surface thereof may also be treated according to the high frequency techniques described herein.

Embodiments described hereinabove include techniques for allowing the use of cost-effective materials to be employed in downhole tool and device construction without unreasonable concern over suitability for long term exposure to a well environment. The described techniques provide for compressive layer that improves corrosion crack resistance beyond that achievable through conventional blasting or shot peening. In certain embodiments, this is due to the significantly greater thickness of compressive layer achievable through techniques detailed herein.

The preceding description has been presented with reference to presently preferred embodiments. However, other embodiments not detailed hereinabove may be employed. Furthermore, persons skilled in the art and technology to which these embodiments pertain will appreciate that still other alterations and changes in the described structures and methods of operation may be practiced without meaningfully departing from the principle and scope of these embodiments. Additionally, the foregoing description should not be read as pertaining only to the precise structures described and shown in the accompanying drawings, but rather should be read as consistent with and as support for the following claims, which are to have their fullest and fairest scope.

We claim:

1. A method of treating a downhole device for exposure to an environment of a hydrocarbon well, the method comprising:

positioning the device in a chamber adjacent an high frequency generator;

applying a frequency to the chamber with the generator to form a compressive layer at a surface of the device with high frequency particles; and reducing the temperature of the device to less than about 0° C. during said applying to increase a thickness of the layer.

2. The method of claim 1 wherein the frequency is between about 50 Hz and about 25 kHz.

3. The method of claim 1 wherein said reducing is achieved via introduction of a temperature reducing fluid to the chamber.

4. The method of claim 3 wherein the fluid is cryogenic.

5. The method of claim 4 wherein the fluid is a liquid of one of nitrogen, carbon dioxide and argon.

6. The method of claim 1 further comprising rotating the device in the chamber during said applying.

7. The method of claim 6 wherein said rotating promotes one of uniformity in a thickness of the layer and an increase in a rate of formation of the layer.

8. The method of claim 1 wherein said applying comprises:

focusing a delivery of the particles to the surface; and moving the device in the chamber to expand the delivery across the surface.

9. The method of claim 1 further comprising treating portions of the device with a laser peening application following said applying.

10. The method of claim 1 further comprising: coating the surface with a dye prior to said positioning; and visually examining the surface following said applying to confirm an effectiveness of the treating.

11. The method of claim 1 further comprising delivering a protective overlay to the layer.

12. The method of claim 11 wherein the protective overlay is an ultra-fine powder comprising one of chromium, molybdenum and nickel.

13. An assembly for high frequency treatment of a downhole device, the assembly comprising:

a chamber for accommodating high frequency particles and the device, the particles selected from a group consisting of ceramic, steel and chromium; and a high frequency generator coupled to the chamber for inducing the particles to bombard a surface of the device at a given frequency to form a compressive layer thereat.

14. The assembly of claim 13 wherein the particles are between about 0.5 mm and about 10 mm in diameter.

15. The assembly of claim 13 wherein the particles include a material for alloying with the surface during the inducing.

16. The assembly of claim 13 further comprising a rotation mechanism for rotating the device in the chamber during the inducing.

17. The assembly of claim 13 wherein said chamber further accommodates a temperature reducing fluid to increase a thickness of the layer.

18. The assembly of claim 13 wherein the device is a tubular with a temperature reducing fluid therein to increase a thickness of the layer at an outer surface thereof exposed to the particles.

19. The assembly of claim 13 wherein the device is a tubular accommodating the particles therein, said chamber further accommodating a temperature reducing fluid to increase a thickness of the layer at an inner surface of the tubular.

* * * * *